US005508473A

United States Patent [19]

Chafe

[11] Patent Number: 5,508,473

[45] Date of Patent: Apr. 16, 1996

[54] MUSIC SYNTHESIZER AND METHOD FOR SIMULATING PERIOD SYNCHRONOUS NOISE ASSOCIATED WITH AIR FLOWS IN WIND INSTRUMENTS

[75] Inventor: Christopher D. Chafe, Palo Alto, Calif.

[73] Assignee: The Board of Trustees of the Leland Stanford Junior University, Stanford, Calif.

[21] Appl. No.: 240,871

[22] Filed: May 10, 1994

[51] Int. Cl.[6] ..... G10H 5/02

[52] U.S. Cl. ..... 84/659; 84/661

[58] Field of Search ..... 84/600, 622, 626, 84/630, 659, 661

[56] References Cited

U.S. PATENT DOCUMENTS

| | | | |
|---|---|---|---|
| 5,157,216 | 10/1992 | Chafe | 84/695 |
| 5,192,825 | 3/1993 | Kunimoto | 84/661 |
| 5,286,914 | 2/1994 | Kunimoto | 84/660 X |
| 5,340,942 | 8/1994 | Kunimoto | 84/661 |
| 5,382,751 | 1/1995 | Kitayama et al. | 84/661 |
| 5,408,042 | 4/1995 | Masuda | 84/661 |

*Primary Examiner*—William M. Shoop, Jr.
*Assistant Examiner*—Jeffrey W. Donels
*Attorney, Agent, or Firm*—Flehr, Hohbach, Test, Albritton & Herbert

[57] ABSTRACT

A music synthesizer simulates the musical tones of wind instruments. The synthesizer includes a vopex noise generator, an edge tone nonlinearity function driven by the differential between a blowing pressure signal and a feedback signal from the resonator. The vopex noise generator feeds its noise output signal back into itself so as to generate a noise "votex". The vopex noise generator furthermore modulates the spectral content of the generated noise fluctuates in a manner that is period synchronous with the resonator output signal. As a result, the noise vopex signals mimic the turbulence associated with air blown into wind instruments by switching between structured and chaotic modes of operation in a manner that is period synchronous with the resonator output signal. The transfer characteristic of the edge tone nonlinearity function is dynamically controlled by the noise signal so as to change the operating point of the edge tone nonlinearity. Since the noise signal is changing in a manner that is period synchronous with the resonator output signal, the transfer characteristic of the edge tone nonlinearity function is also dynamically modulated in a manner that is period synchronous with the resonator output signal. The resulting period synchronously modulated edge tone signal is injected into the resonator, creating microvariations in the amplitude and frequency of the output signal generated by the resonator, thereby mimicking the noise component of the sounds produced by acoustic wind instruments.

17 Claims, 4 Drawing Sheets

MUSIC SYNTHESIZER AND METHOD FOR SIMULATING PERIOD SYNCHRONOUS NOISE ASSOCIATED WITH AIR FLOWS IN WIND INSTRUMENTS

The present invention relates generally to electronic music synthesizers, such as music synthesizers that mimic the sound of acoustic wind instruments, and more particularly to a new system and method for generating spectrally shaped, period synchronously modulated noise components that mimic the turbulent noise associated with air flows in wind instruments.

BACKGROUND OF THE INVENTION

The present invention is related to the music synthesizer and method of U.S. Pat. No. 5,157,216 issued to the same inventor, Christopher D. Chafe, and assigned to the same assignee as the present invention.

Musical tones from acoustic bowed string and wind instruments, though nearly periodic, have a noise component that is a subtle but crucial part of the sound. The invention in U.S. Pat. No. 5,157,216 and the present invention are attempts to simulate these instruments in digital electronic synthesizers and to improve the quality of the noise component of the musical sounds generated by those synthesizers.

The present invention is based on a new description or model of the noise generation mechanism in wind instruments, including the flute, saxophone, clarinet, oboe, other single and double reed instruments, lip reed instruments, air jet instruments and the voice (including whispers and glottal sounds).

Analyses by the inventor have verified the existence of the noise predicted by this new model, and digital simulations using the present invention have synthesized tones with improved edge tones and reed-tone sound qualities.

The precise quality of the noise generated when electronically synthesizing the tones of wind instruments is important in achieving an improved sound synthesis capability. It is also important to model the edge tones and reed tones generated by reeds and switching air jets, and the noise component of those reed tones and edge tones, in order to generate sounds similar to those generated by acoustic wind instruments. Mixing sets of sinusoidal waveforms with spectrally shaped Gaussian noise has not proved sufficient. There is no perceptual fusion of the noise and periodic sounds, and the listener hears two sources. A subjective impression from the best attempts to mix in spectrally shaped Gaussian noise is that the noise is "not well-incorporated." The present invention uses a form of period synchronous noise to affect the operation of edge-tone/reed-tone generation, and thus to affect the quality of synthesized edge tones and reed tones, which are then used to drive a resonator.

SUMMARY OF THE INVENTION

In summary, the present invention is a music synthesizer which simulates the musical tones of wind instruments. The synthesizer includes a vortex noise generator, a edge/reed tone nonlinearity function driven by the differential between a blowing pressure signal and a reflected signal from the resonator. The vortex noise generator feeds its noise output signal back into itself so as to generate a noise "vortex". The vortex noise generator also receives a signal corresponding to the output signal generated by the resonator. The spectral content of the generated noise is a function of the reflected resonator signal, and thus the spectral content of the generated noise fluctuates in a manner that is period or pitch synchronous with the resonator output signal. More particularly, the noise vortex generator generates noise signals that mimic the turbulence associated with air blown into wind instruments by switching between structured and chaotic modes of operation in a manner that is period synchronous with the simulated resonator's output signal.

The transfer characteristic of edge/reed tone nonlinearity function is dynamically controlled by the noise signal from the noise generator, so as to change the "operating point" of the edge/reed tone nonlinearity. Since the noise signal is changing in a manner that is period synchronous with the output signal produced by the resonant signal generator, the transfer characteristic of the edge/reed tone nonlinearity function is also dynamically modulated in a manner that is period synchronous with the output signal produced by the resonant signal generator. This period synchronous modulation of the edge/reed tone's transfer characteristic is intuitively similar to the period synchronous pulsing or modulation of the air that is injected into a wind instrument. The resulting period synchronously modulated edge/reed tone signal is injected into the resonator, creating microvariations in the amplitude and frequency of the output signal generated by the resonator, thereby mimicking the noise component of the sounds produced by acoustic wind instruments.

In summary, the general principal of the present invention is to period synchronously modulate the spectral content of a noise signal, and to add that period synchronously modulated noise signal to an excitation signal for energizing a resonating system, which results in the generation of synthesized sound having appropriate noise characteristics for wind instruments.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
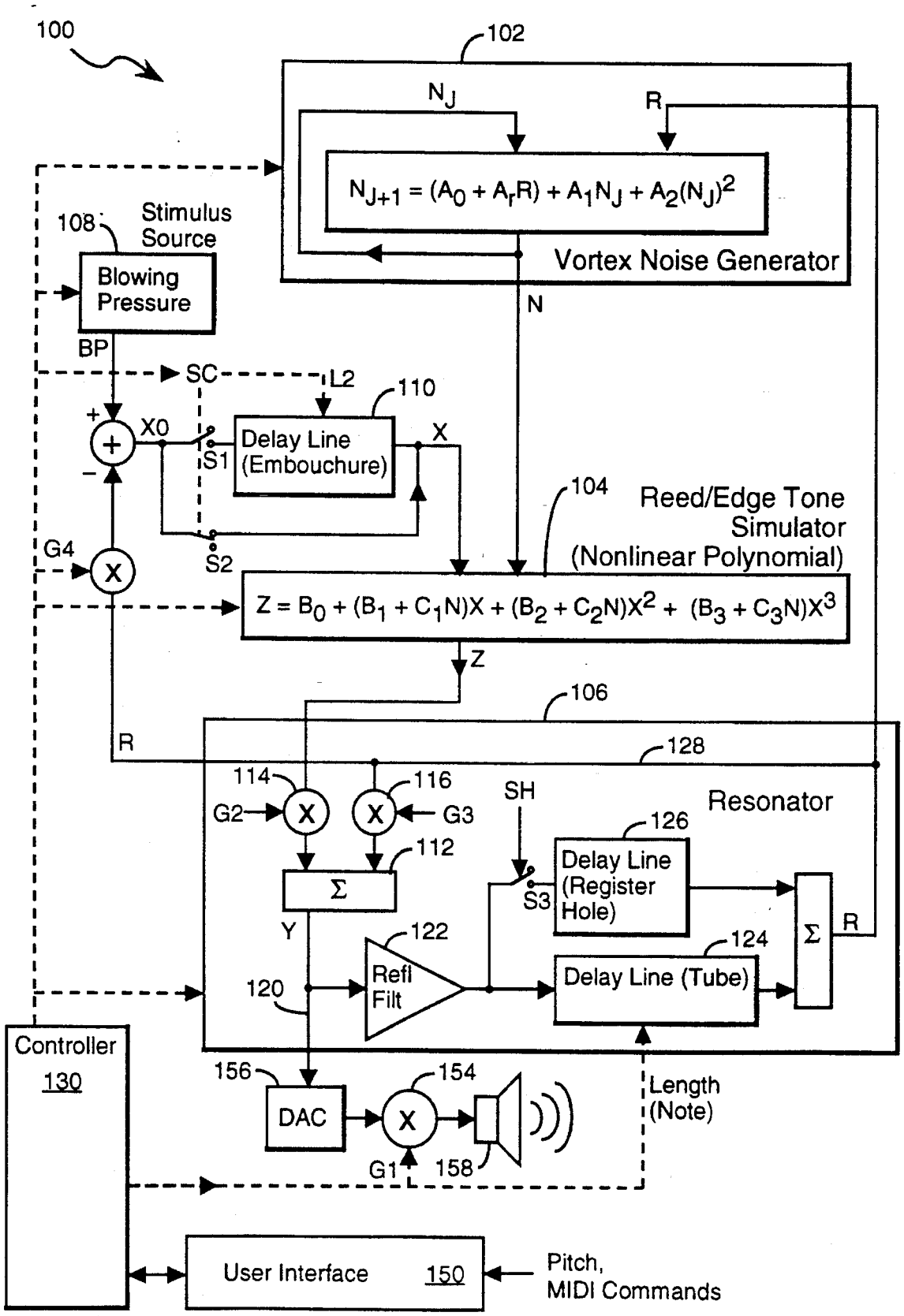
FIG. 1 is a block diagram of a musical synthesizer incorporating a preferred embodiment of the present invention.

For the purposes of this document the term "edge tone" is defined to mean a signal that represents the noisy air flow input to the resonator portion of a wind instrument.

The following is a brief explanation of the theory of operation of the present invention. While this theory helps to explain how the invention works, it should be understood that this theory of operation forms no part of the present invention.

Theory of Operation

The present invention is based on an improved physical model of wind instruments and the physical process by which these instruments generate sound. In particular, this physical model is a model of the non-sinusoidal aspects of wind instrument sounds, particularly those which are associated with "reed noise" in reed instruments and "edge tone noise" in instruments such as flutes. Reeds in reed instruments vibrate rapidly, and the air flows in switching air jet instruments (flutes and the like) also fluctuate rapidly. These vibrating, noisy air flows, herein called edge tones (for wind instruments without reeds) and reed tones (for reed instruments), are then injected into a tube or other resonant chamber, where the injected air generates a musical sound that is a function of the shape of the chamber as well as of the injected noisy air flows.

It is the inventor's theory that when air is blown into a wind instrument, the physical reed or switching air jet of the instrument acts as a nonlinearity whose operating point fluctuates rapidly, in a noisy manner, so as to generate the microvariations in amplitude and frequency observed in acoustic wind instruments.

It is important to note that the fluctuating operating point of the reed nonlinearity is distinct from fluctuating air pressure on the reed. Air pressure on the reed fluctuates in manner that is period synchronous with the output of the musical instrument because back pressure from the instrument's resonant chamber affects the net input air pressure on the reed, and the back pressure itself fluctuates in a manner that is period synchronous with the output waveform produced by the instrument. To mimic the period synchronous input air pressure fluctuations, a back pressure signal is subtracted from the blowing pressure input signal. The use of a back pressure feedback signal to produce a differential air pressure signal is conventional.

Fluctuations of the reed nonlinearity's operating point are believed to be caused by vibrations associated with the musical sound being generated by the instrument. In the present invention a noise signal is used to modulate the operating point of the reed/edge tone nonlinearity. Furthermore, the noise signal is produced by a noise generator that is connected to a feedback loop from the instrument's main resonator such that the spectral content of the noise signal is controlled or modulated by a signal corresponding to the output signal from the main resonator. As a result, the noise signal that modulates the reed simulator's nonlinearity operating point fluctuates in a manner that is period synchronous with the with the output of the synthesizer.

Preferred Embodiment—Model

Referring to FIG. 1, a music synthesizer 100 representing a preferred embodiment of the present invention includes a vortex noise generator 102, a reed tone or edge tone simulator 104, and a resonator 106.

A stimulus source, 108, provides a signal representing the blowing pressure BP applied to the instrument. The blowing pressure signal BP is a DC signal that will typically rise and fall in accordance with the phrasing of the musical composition being synthesized, much as the blowing pressure applied by a person to an acoustic wind instrument would vary to control volume and the like.

The excitation signal injected into the synthesizer's reed tone/edge tone generator 104 is the differential X between the blowing pressure BP and an attenuated version of a reflection signal R reflected back from the instrument's output:

$$X0=X=BP-G4\times R$$

where G4 is an attenuation factor set equal to 0.5 in the preferred embodiment. Reflection signal R is typically a waveform having a number of fairly stable frequency components with a primary pitch component generally having a larger amplitude than the other frequency components of the R waveform.

When the instrument being simulated is a reed or brass wind instrument, the input signal X to the reed/edge tone generator 104 is set directly equal to the differential input signal X0. When the wind instrument being simulated is a flute or other edge-tone instrument, the differential input excitation signal X0 is delayed through a short, first delay line 110 to generate the input signal X. The delay line 110 represents the time delay associated with air flowing from a person's lips to the back edge of a flute's inlet. Furthermore, the length of this delay line 110 is usually varied in accordance with the pitch of the note being played. The embouchure delay line 110 is patched in and out of the synthesizer circuit 100 by two signal flow switches S1 and S2, which in turn are controlled by a switching signal SC such that when switch S1 is open, switch S2 is closed, and vice versa.

In the preferred embodiment, all signals or waveforms in the synthesizer are updated at a rate of 44,100 samples per second. Thus the output signal generated by the synthesizer can have frequency components up to approximately 22 kHz. Furthermore, all the signals in the synthesizer 100 (other than intermediate values produced while updating the polynomial function output values associated with the noise generator and reed/edge tone generator) are automatically clipped or limited to a range of −1 to +1. This signal limiting process is known as signal "normalization".

It should also be noted that the operation of the resonator 106 is well known to those skilled in the art. For the moment, the only feature of the resonator 106 that needs to be noted is that the output signal Y and the reflection signal R are almost identical in terms of spectral content. In the preferred embodiment the reflection signal R is used as a feedback signal not only within the resonator 106 itself, but also as a feedback signal to the blowing pressure input to the synthesizer and to the vortex noise generator 102. However, since the output signal Y and the reflection signal R are almost identical, in other embodiments of the invention the output signal Y itself can be used as the feedback signal to the synthesizer input and/or to the vortex signal generator.

Vortex Noise Generator

In the preferred embodiment, the vortex noise generator 102 is a recursive or iterative mapping function or polynomial whose primary input $N_j$ is equal to the noise signal output by the previous computation cycle. The vortex noise generator also has a secondary input, which is a feedback signal from the resonator 106 corresponding to the reflected portion R of the musical output signal Y from the resonator. The noise vortex polynomial in a first preferred embodiment is as follows:

$$N_{j+1}=-0.6+0.1R-0.6N_j+2N_j^2 \quad (1)$$

The noise vortex polynomial in a second preferred embodiment is as follows:

$$N_{j+1}=-0.8+0.2R-0.8N_j+2N_j^2 \quad (2)$$

These and other recursive or iterative polynomial mapping functions provide a variety of different frequency characteristics for different values of the feedback signal R. In particular, for some ranges of R the noise signal N oscillates within relatively small signal value ranges, in other ranges of R the noise signal N oscillates over a growing range of values, and in still other ranges of R the noise signal N is highly chaotic but has distinct harmonics and internal structure that make it non-Gaussian. In some cases, depending on the attenuation factor the feedback signal R, the noise signal N may be even become a DC signal for some values ranges of R. Thus, the spectral content of the noise signal N is a function of the feedback signal R. Furthermore, since the value R is itself a time varying waveform, the noise signal N will have varying spectral content over the period of the R waveform.

Figure 2:
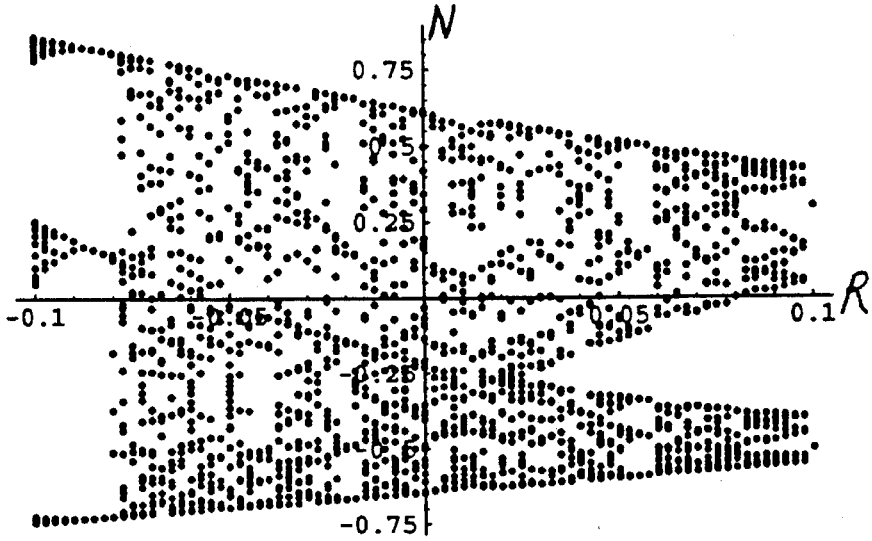
FIG. 2 depicts output signal values generated by an example of the noise vortex used in a preferred embodiment for different ranges of a reflective feedback signal.

FIG. 2 depicts typical outputs generated by the noise vortex 102 when using the quadratic iterated mapping function shown in equation 1, above.

More generally, the vortex noise generator's iterated or recursive mapping function is of the form:

$$N_{j+1}=A_0+A_1N_j+A_2N_j^2+\ldots A_nN_j^n \quad (3)$$

where one or more of the coefficients $A_i$ are modulated by the feedback signal R.

The coefficients and the number of terms in the above equation can be set to values other than those used in equations 1–2, so as to produce a chaotic noise signal for some value ranges of R and to produce a more structured signal for other value ranges of R.

Edge/Reed Tone Generator

For simplicity, the reed tone or edge tone generator 104 will hereinafter be called the edge tone generator. However, the same type of nonlinear transformation function is used for synthesizing the sound associated with reed instruments. The output signal Z generated by the edge tone generator 104 is a nonlinear function of the input X to the edge tone generator, represented by a polynomial of the form:

$$Z=\sum_{i=0}^{M}(B_i+C_iN)X^i \quad (4)$$

where M is an integer larger than 1. M is typically equal to 2 or 3, and thus the edge tone nonlinear polynomial is typically a second or third order polynomial. To model the affect of the noise signals N on the edge tone generator, at least one of the coefficients (typically the $B_1$ and $B_3$ coefficients) in equation 4 are modulated by the noise signal N.

In a preferred embodiment, for synthesizing sounds similar to those generated by an acoustic flute, the edge tone generators's nonlinear polynomial is a cubic polynomial (i.e., M=3) and the coefficients for the edge tone generator's polynomial as represented by Equation 4, are assigned as follows: $B_0=0$, $B_1=-0.3$, $B_2=0$, $B_3=0.5$, $C_0=O$, $C_1=-0.1$, $C_2=0$ and $C_3=0.1$. The resulting nonlinear polynomial is:

$$Z=-(0.3+0.1N)X+(0.5+0.1N)X^3 \quad (5)$$

In a second preferred embodiment, the edge tone nonlinear polynomial is:

$$Z=-(0.25+0.0625N)X+(0.4+0.0625N)X^3 \quad (6)$$

Figure 3:
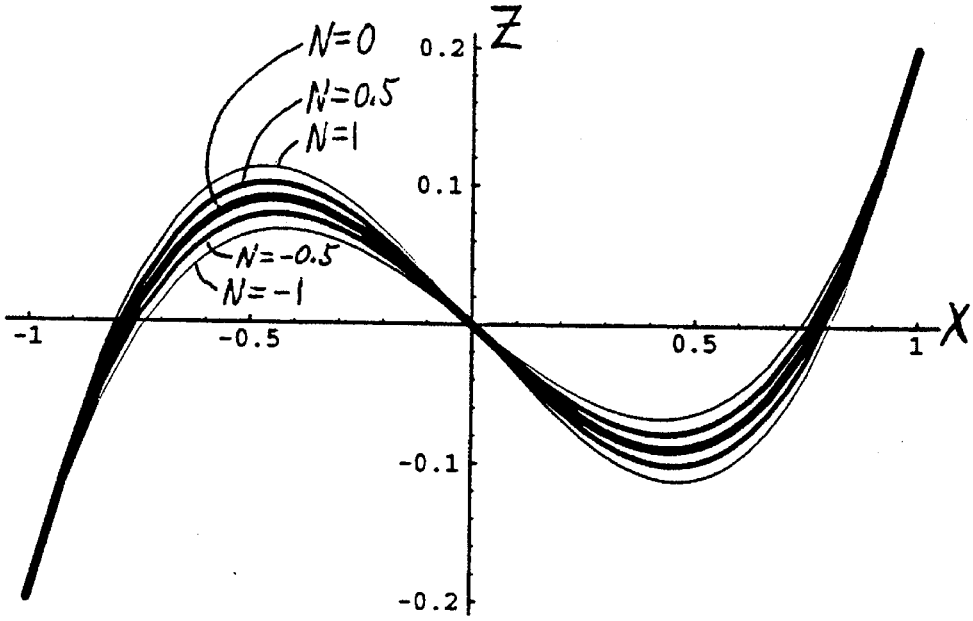
FIG. 3 is a graph depicting a mapping of an edge tone nonlinearity function for several noise signal values.

FIG. 3 is a graph depicting a mapping of the edge tone nonlinearity function of equation 5 for N=–1, N=–0.5, N=0, N=0.5 and N=1.0.

When the instantaneous differential air pressure X is low, there is more resistance to injected air than when the air pressure is high. As a result, the velocity of air injected into a wind instrument is a nonlinear function of the instantaneous air pressure. The cubic polynomials in equations 5 and 6 represent the relationship of instantaneous differential air pressure to air being injected into the air column of a wind instrument (e.g., through the reed in reed instruments or through the air jet in "air reed" (switching air jet) instruments (e.g., the flute, recorder, shakuhachi, etc.).

As shown in FIG. 3, the operating point of the edge tone generator's transfer function is modulated by the noise signal N. More specifically, the coefficients of the edge tone generator's nonlinear polynomial are modulated by the noise signal N. Furthermore, the noise signal N's spectral content is itself a period synchronous function of the reflected output signal generated by the synthesizer 100. As a result, the edge tone generator's nonlinear transfer function is modulated by the noise signal N in a manner that is period synchronous with the output signal.

Signal Resonator

The signal resonator 106, includes a "jet adder" 112 coupled to two scaling multipliers 114, 116. The first scaling multiplier scales the edge tone signal Z received from the edge tone generator 104, and the second scaling multiplier 116 scales the resonator's reflection feedback signal R. In the preferred embodiment, the first scaling multiplier 114 scaled the edge tone signal by a factor of G2=0.7 and the second scaling multiplier scales the reflection feedback signal R by a factor of G3=0.8. As a result, the jet adder 112 generates a musical output signal Y on node 120 in accordance with:

$$Y=0.7Z+0.8R \quad (7)$$

Figure 4:
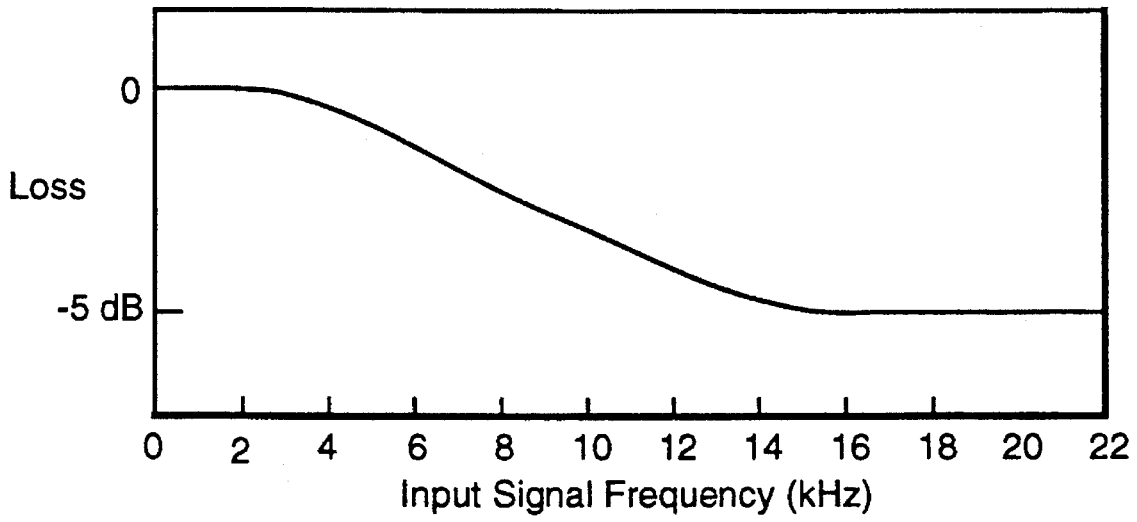
FIG. 4 shows the frequency response function of a reflection filter used in the resonator of the preferred embodiment of the present invention.

The musical output signal Y is generated by the resonator 106 using an oscillator loop that includes a reflection filter 122, a variable length delay line 124 that simulates the operation of a wind instrument's tube and the jet adder 112 and its scaling multipliers 114, 116. In the preferred embodiment, the reflection filter is an infinite impulse response (11R) filter. As shown in FIG. 4, the reflection filter 122 has a frequency transfer curve that attenuates frequency components of the output signal above 2 kHz, with the attenuation increasing fairly linearly from 0 dB to about 5 dB between 2 kHz and 15 kHz, and with all frequency components above 15 kHz being attenuated by about 5 dB.

A fixed length delay line 126 that is parallel to delay 124 but shorter in length is switched by switch S3 into the oscillator loop only when the frequency of the musical output signal is to be increased by a set ratio, such as an octave, and thus the shorter delay line 126 mimics the operation of a register hole in a flute.

The reflection feedback signal R is generated on node 128. In the preferred embodiment, the reflection feedback signal R, in addition to being used in the resonator's oscillator loop to generate the output signal Y, is combined with the input blowing pressure signal to generate the differential excitation signal X, and is also input to the vortex noise generator 102, as described above.

The delay time of the delay line 124 is specified by the synthesizer's controller 130. Typically, the delay time is inversely proportional to the frequency of the fundamental tone being synthesized.

Music Synthesizer Controller

Figure 5:
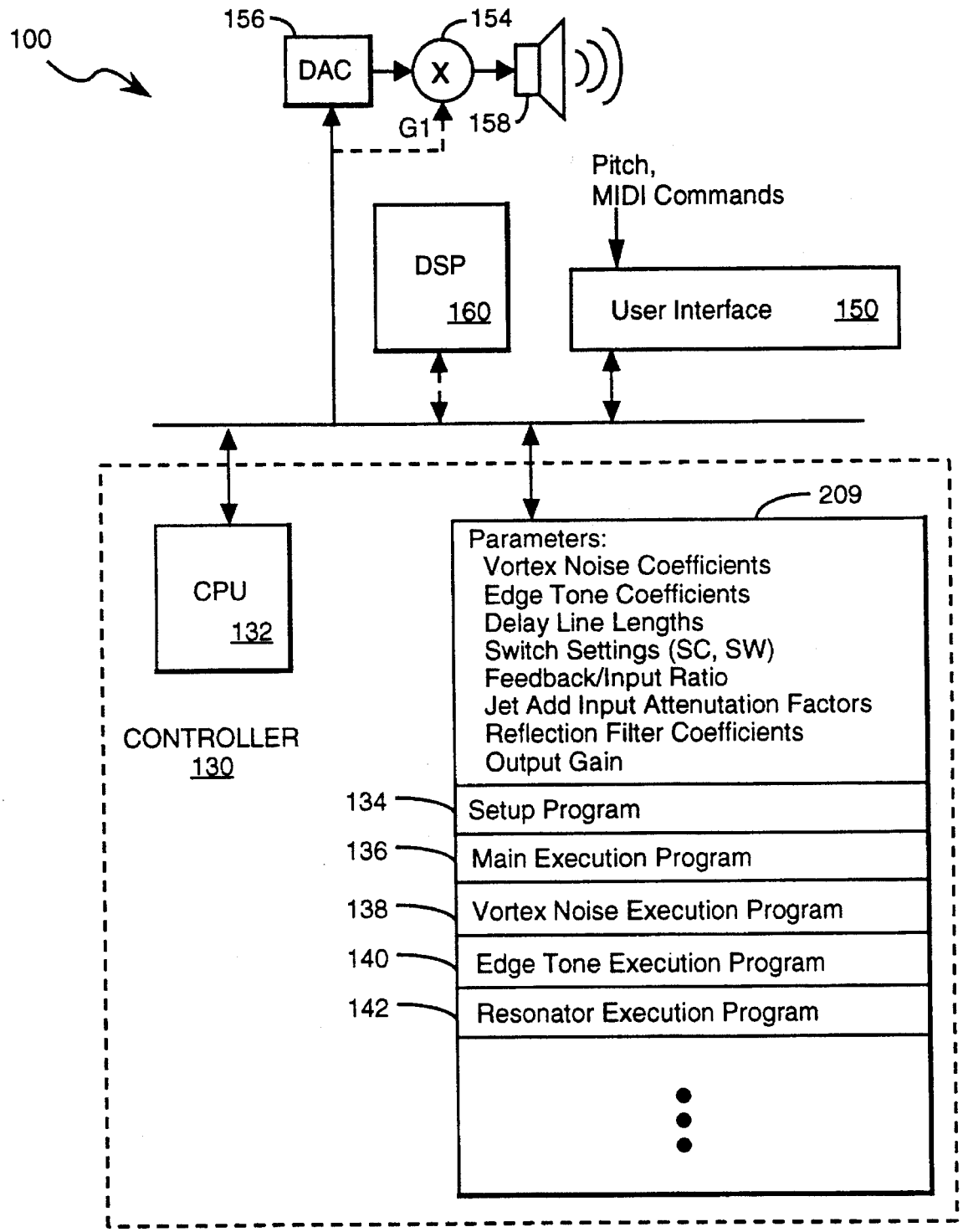
FIG. 5 is a second block diagram of a musical synthesizer incorporating a preferred embodiment of the present invention.

Referring to FIGS. 1 and 5, the operation of music synthesizer 100 is controlled by a controller 130, typically a microprocessor 132 such as those found in Yamaha synthesizers or the microprocessors found in desktop computers. The controller 130 receives commands from a user interface 150 that typically includes command input devices such as a set of function buttons, vibrato and other control wheels, a keyboard for specifying tones or notes to be generated, as well as output devices such as an LCD display and other visual feedback output devices that confirm user commands and inform the user of the state of the synthesizer. In most implementations, the user interface 150 can be coupled to a computer so as to receive MIDI commands, pitch values and the like from a computer.

The controller 130 preferably includes a setup program 160 that generates and stores control parameters for the main resonator 106, such as delay line lengths for the resonator's delay lines 124 and 126, junction parameters that determine the resonating properties of the resonator 106, filter parameters that determine the transfer characteristics of the reflection filter, and the gain constant G1 of the resonator's output amplifier 154. Similarly, the setup program sets control parameters for the vortex noise generator and the edge tone generator, and also determines the settings of the embouchure switches and the embouchure delay length.

Music synthesis by the system 100 is performed under the control of a main execution program 136 that calls vortex noise, edge tone and resonator execution programs 138, 140, 142 for each sampled time period so as to generate the differential input signal, the noise signal, the edge tone signal, music sound output signal and reflection signal for each sampled time period.

The signals output by the resonator 106 are converted from digital form to an analog voltage by a digital to analog converter 156, are amplified by the output amplifier 154 and then transmitted to one or more speakers 158 so as to generate audible sounds.

Referring to FIG. 5, the present invention can be implemented on a conventional computer system having a CPU 132 such as the PowerPC made by Motorola or the Pentium made by Intel. In order to execute the music synthesizer's execution programs in real time, especially if more than one "voice" is to be generated in real time, it is usually preferable to utilize a system 100 that includes a host CPU 132 and a digital signal processor (DSP) 160, or to use a computer with a microprocessor that can pipeline single instruction cycle multiply operations so as to efficiently perform the computations associated with the present invention.

Alternate Embodiments

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

Figure 6:
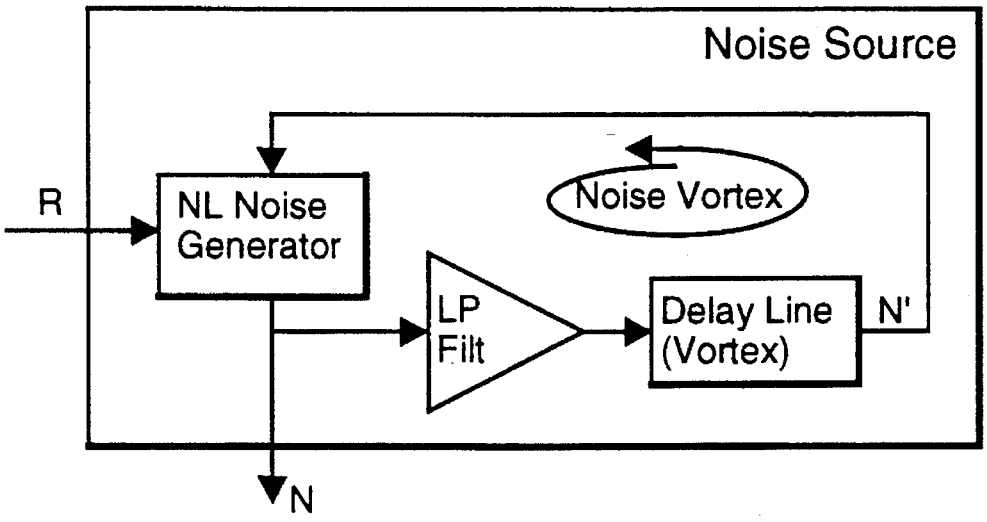
FIG. 6 is a block diagram of an alternate vortex noise generator for use in an alternate embodiment of the present invention.

For instance, the noise generators of the preferred embodiment could be replaced with any number of noise generators. A noise vortex can be created using a number of different iterative mapping functions, and can also be created using a variety of signal feedback loops with components selected from the group consisting of filters, nonlinearity functions and delay lines. For instance, FIG. 6 is a block diagram of an alternate vortex noise generator using such components. Other, non-vortex noise generators could also be used in the present invention, especially noise generators whose output spectral content can be varied or amplitude modulated in a manner that is period synchronous with the resonator's output signal.

Similarly, a wide variety of edge tone and reed tone nonlinearity functions could be used in place of the ones in the preferred embodiments. A number of such nonlinear functions are known in the art of music synthesis, with most being second or third order polynomials. These functions may be stored in tables, rather than being computed for each iteration, to improve computational efficiency.

The present invention may also be used to simulate the noise component of musical instruments other than wind instruments, although the inventor has not yet explored such applications of the present invention.

While the preferred embodiments described above use a "lumped circuit" approach to representing the action of a reed or air jet, an array of edge tone generators and an array of vortex noise generators implemented in accordance with the present invention could be used to provide a two dimensional or three dimensional simulation of the air flow characteristics of a synthesized wind instrument.

What is claimed is:

1. A musical sound synthesizer, comprising:

a stimulus source for providing a stimulus signal;

a noise generator that generates a noise signal N;

a nonlinear signal generator coupled to said stimulus source and to said noise generator and having an output, said nonlinear signal generator generating an edge tone signal Z on said output that is a function of said stimulus signal, wherein said nonlinear signal generator has a transfer characteristic that is modulated by said noise signal;

an acoustic signal resonator that is driven by said edge tone signal and generates a musical sound signal; and an output for transmitting an output signal corresponding to said musical sound signal.

2. A musical sound synthesizer as set forth in claim 1, said noise generator including an input port for receiving a signal corresponding to said musical sound signal, said noise generator generating said noise signal as a function of said received signal such that said noise signal's spectral content changes in a manner that is period synchronous with said musical sound signal.

3. A musical sound synthesizer, comprising:

a stimulus source for providing a stimulus signal;

a noise generator that generates a noise signal N;

a nonlinear signal generator coupled to said stimulus source and to said noise generator and having an output, said nonlinear signal generator generating a signal Z on said output that is a function of said stimulus signal using a nonlinear polynomial of the form $$Z = \sum_{i=0}^{M} (B_i + C_i N) X^i$$

where X corresponds to said stimulus signal and M is an integer larger than 1, and $B_i$ and $C_i$ are constants;

an acoustic signal resonator that is driven by said signal Z and generates a musical sound signal; and an output for transmitting an output signal corresponding to said musical sound signal.

4. A musical sound synthesizer as set forth in claim 3, said noise generator including an input port for receiving a signal corresponding to said musical sound signal, said noise generator generating said noise signal as a function of said received signal.

5. A musical sound synthesizer as set forth in claim 4, said noise generator generating said noise signal in accordance with a nonlinear polynomial of the form $$N_{J+1}=A_0+A_1N_J+A_2N_J^2 \ldots A_nN_J^n$$

where N corresponds to said noise signal, $A_0$, $A_1 \ldots A_n$ are coefficients, and wherein at least one of said coefficients is modulated by said received signal.

6. A musical sound synthesizer as set forth in claim 4, said noise generator generating said noise signal in accordance with a nonlinear polynomial of the form $$N_{j+1}A_0A_rR+A_1N_j+A_2N_j^2+\ldots A_nN_j^n$$

where R corresponds to said received signal, N corresponds to said noise signal, and $A_0$, $A_r$, $A_1 \ldots A_n$ are constant coefficients.

7. A musical sound synthesizer as set forth in claim 3, said acoustic signal resonator including a reflection feedback loop having a low pass filter for filtering a first signal corresponding to said musical sound signal to produce a reflection signal, a first delay line having an input coupled to said low pass filter to receive said reflection signal, said first delay line generating a delayed reflection signal, and a signal combiner that combines said delayed reflection signal with said signal Z to generate said musical sound signal.

8. A method of synthesizing sounds, the steps of the method comprising:

generating an audio output signal and a feedback signal with an audio resonator;

generating an excitation signal;

combining said excitation signal with said feedback signal to generate a differential excitation signal;

generating a noise signal;

performing a non-linear transformation of said differential excitation signal to produce a non-linear excitation signal, wherein said non-linear transformation is controlled by said noise signal;

driving said acoustic signal resonator with said nonlinear excitation signal so as to generate said audio output signal; and transmitting an output signal corresponding to said audio output signal.

9. A method of synthesizing sound as set forth in claim 8, wherein said noise generating step includes receiving a signal corresponding to said audio output signal and generating said noise signal as a function of said received signal such that said noise signal's spectral content changes in a manner that is period synchronous with said audio output signal.

10. A method of synthesizing sounds, the steps of the method comprising:

providing a stimulus signal;

generating a noise signal N;

generating a signal Z using a nonlinear polynomial of the form $$Z=\sum_{i=0}^{M}(B_i+C_iN)X^i$$

where X corresponds to said stimulus signal and M is an integer larger than 1. and $B_i$ and $C_i$ are constants;

driving an acoustic signal resonator with said signal Z so as to generate a musical sound signal; and transmitting an output signal corresponding to said musical sound signal.

11. A method of synthesizing sound as set forth in claim 10, wherein said noise generating step includes receiving a signal corresponding to said musical sound signal and generating said noise signal as a function of said received signal such that said noise signal's spectral content changes in a manner that is period synchronous with said musical sound signal.

12. A method of synthesizing sound as set forth in claim 11, said noise generating step including generating said noise signal in accordance with a nonlinear polynomial of the form $$N_{j+1}=A_0+A_1N_jA_2A_2N_j^2+\ldots A_nN_j^n$$

where N corresponds to said noise signal, $A_0$, $A_1 \ldots A_n$ are coefficients, and wherein at least one of said coefficients is modulated by said received signal.

13. A method of synthesizing sound as set forth in claim 11, said noise generating step including generating said noise signal in accordance with a nonlinear polynomial of the form $$N_{j+1}=A_0+Ar_rR+A_1N_j+A_2N_j^2+\ldots A_nN_j^n$$

where R corresponds to said received signal, N corresponds to said noise signal, and $A_0$, $A_r$, $A_1 \ldots A_n$ are constant coefficients.

14. A method synthesizing sound as set forth in claim 10, including filtering a first signal corresponding to said musical sound signal to produce a reflection signal, delaying said reflection signal in a first delay line and combining said delayed reflection signal with said signal Z so as to generate said musical sound signal.

15. A musical sound synthesizer, comprising:

a stimulus source for providing a stimulus signal;

a noise generator that generates a noise signal N; and an acoustic signal generator coupled to said stimulus source and to said noise generator for generating a musical sound signal that is a function of said stimulus signal and said noise signal;

wherein said noise generator includes an input port for receiving a signal corresponding to said musical sound signal, said noise generator modulating said noise signal's spectral content period synchronously with said musical sound signal.

16. A method of synthesizing sounds, the steps of the method comprising:

providing a stimulus signal;

generating a noise signal N;

generating a musical sound signal that is a function of said stimulus signal and said noise signal;

wherein said noise generating step receiving a signal corresponding to said musical sound signal, and modulating said noise signal's spectral content period synchronously with said musical sound signal.

17. The method of claim 16, wherein said generating a musical sound step includes generating an excitation signal that is a function of said stimulus signal and said noise signal, and driving an acoustic signal resonator with said excitation signal so as to generate said musical sound signal.

* * * * *

UNITED STATES PATENT AND TRADEMARK OFFICE

CERTIFICATE OF CORRECTION

PATENT NO. : 5,508,473

DATED : April 16, 1996

INVENTOR(S) : Christopher D. Chafe

It is certified that error appears in the above-indentified patent and that said Letters Patent is hereby corrected as shown below:

In The Abstract:

Column 2 of the title page, line 2, "vopex" should be replaced by --vortex--;

same column, line 5, "vopex" should be replaced by --vortex--;

same column, line 7, "votex" should be replaced by --vortex--;

same column, line 7, "vopex" should be replaced by --vortex--;

same column, line 10, "vopex" should be replaced by --vortex--.

Signed and Sealed this

First Day of October, 1996

*Attest:*

Bruce Lehman

BRUCE LEHMAN

*Attesting Officer*

*Commissioner of Patents and Trademarks*